United States Patent [19]

Koon

[11] Patent Number: 4,730,573

[45] Date of Patent: Mar. 15, 1988

[54] COLLAPSIBLE, FOLDABLE BOAT

[75] Inventor: Terry D. Koon, Florence, Oreg.

[73] Assignee: Ottercraft, Inc., Grants Pass, Oreg.

[21] Appl. No.: 940,654

[22] Filed: Dec. 11, 1986

[51] Int. Cl.[4] ..... B63B 7/00

[52] U.S. Cl. ..... 114/353

[58] Field of Search ..... 114/352, 353, 354, 77 R, 114/77 A

[56] References Cited

U.S. PATENT DOCUMENTS

| | | | |
|---|---|---|---|
| 1,202,643 | 10/1916 | Ames | 114/354 |
| 1,359,806 | 11/1920 | Holmstrom | 114/354 |
| 2,111,555 | 3/1938 | Clark | 114/354 |
| 2,271,338 | 1/1942 | Hamlin, Jr. | 114/354 |
| 3,139,634 | 7/1964 | Craft | 114/354 |
| 3,184,768 | 5/1965 | Thomsom | 114/354 |
| 3,228,042 | 1/1966 | Ogimoto | 114/354 |
| 3,981,035 | 9/1976 | Iwabuchi | 114/354 |
| 4,250,583 | 2/1981 | Jensen | 114/354 |
| 4,282,616 | 8/1981 | Battershill | 114/354 |

FOREIGN PATENT DOCUMENTS

| | | | |
|---|---|---|---|
| 1167509 | 10/1969 | United Kingdom | 114/352 |

*Primary Examiner*—Sherman D. Basinger
*Assistant Examiner*—Jesûs D. Sotelo
*Attorney, Agent, or Firm*—Eugene D. Farley

[57] ABSTRACT

A collapsible foldable boat comprises a plurality of waterproof structural plates arranged in spaced relation to each other in the form of a boat hull, and a plurality of waterproof, flexible connecting pieces sealed to the plates and hinging them to each other. The plates are arranged in spaced longitudinal and transverse rows to enable folding both longitudinally and transversely. Interlocking end bulkheads, keelboard, and side rails maintain the boat disassembleably in a rigid, stable, assembled condition.

14 Claims, 10 Drawing Figures

FIG. 8
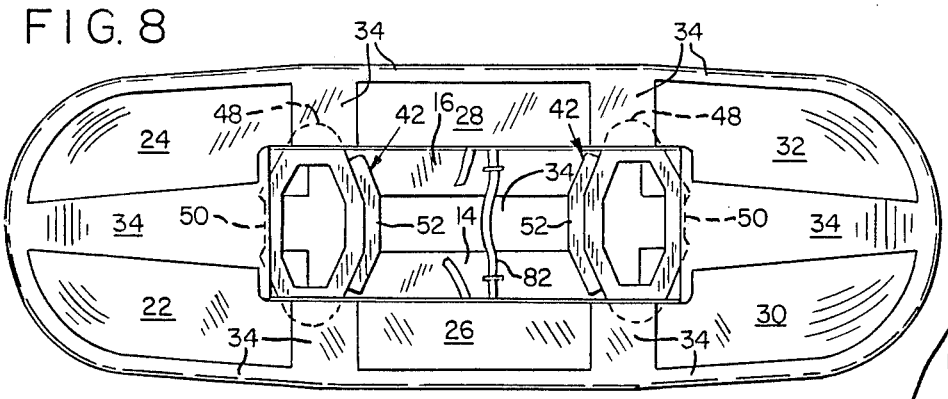
FIG. 7
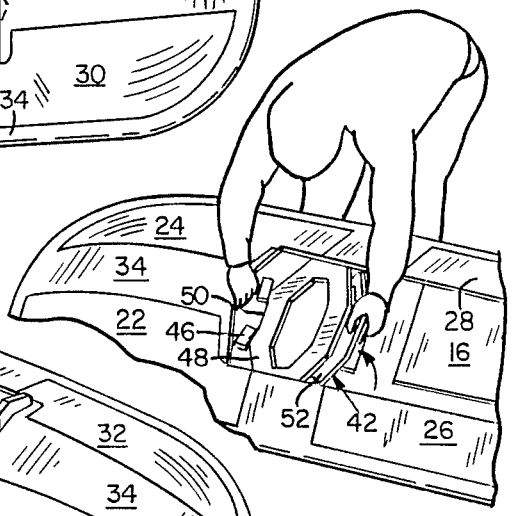
FIG. 9
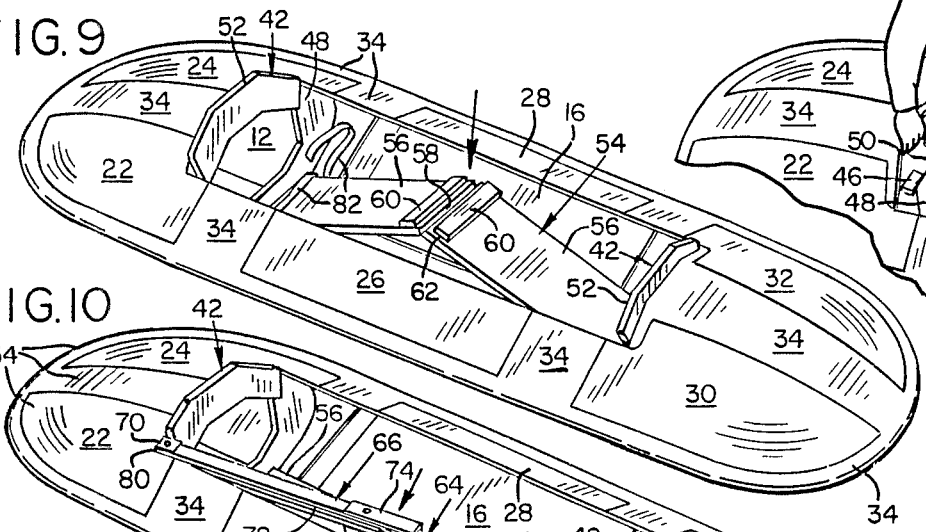
FIG. 10
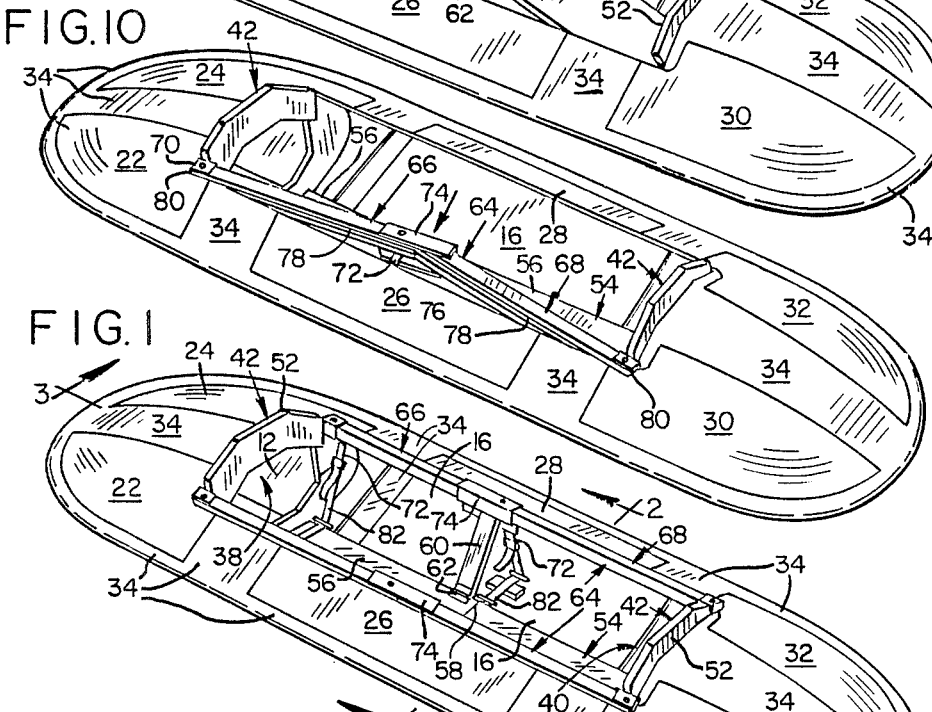
FIG. 1
FIG. 3
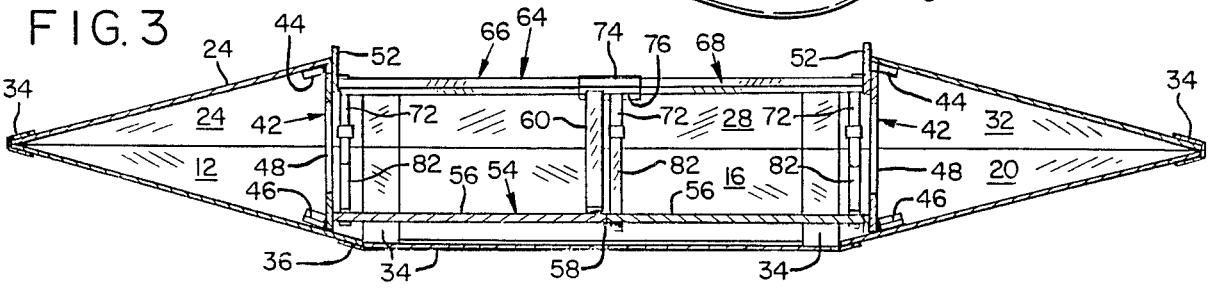

COLLAPSIBLE, FOLDABLE BOAT

BACKGROUND AND GENERAL STATEMENT OF THE INVENTION

This invention relates to collapsible boats. It pertains particularly to a collapsible boat which may be folded into small compass for transportation to the use site and storage between uses.

It is the general purpose of the present invention to provide a collapsible, foldable boat which, in the transportation and storage mode is compact, lightweight, and readily portable; which, at the use site, may be assembled easily and rapidly; which is rigid, stable and safe in use; which is sturdy, durable and easy to maintain; which is easy to row or paddle; which is adaptable for use with a small outboard motor; which, considering its size and weight, has a high load carrying capacity; which is seamless and does not leak; and which, after each use, can be collapsed and folded simply, easily and with a minimum of effort.

The boat achieving the foregoing objects and possessing the foregoing advantages, broadly stated, comprises a plurality of waterproof structural plates arranged in spaced relation to each other in the form of a boat hull which may be defined by a bottom, a forward deck, a rear deck, side decks, and a central cockpit. The plates are arranged in spaced longitudinal and transverse rows to enable folding the boat in its collapsed condition both longitudinally and transversely, ensuring a small overall dimension of the folded article. Fore and aft bulkhead members, a keelboard, and side rails interlock releasably with the plate members comprising the hull to lend rigidity and stability to the boat in its assembled condition.

THE DRAWINGS

In the drawings:

FIG. 1 is a top perspective view of the herein described collapsible foldable boat;

FIG. 3 is a longitudinal sectional view taken along line 3—3 of FIG. 1;

FIGS. 7, 8, 9 and 10 are top perspective views illustrating the various steps involved in the assembly (and disassembly) of the boat.

DESCRIPTION OF A SPECIFIC EMBODIMENT OF THE INVENTION

Figures 2, 4, 5, 6:
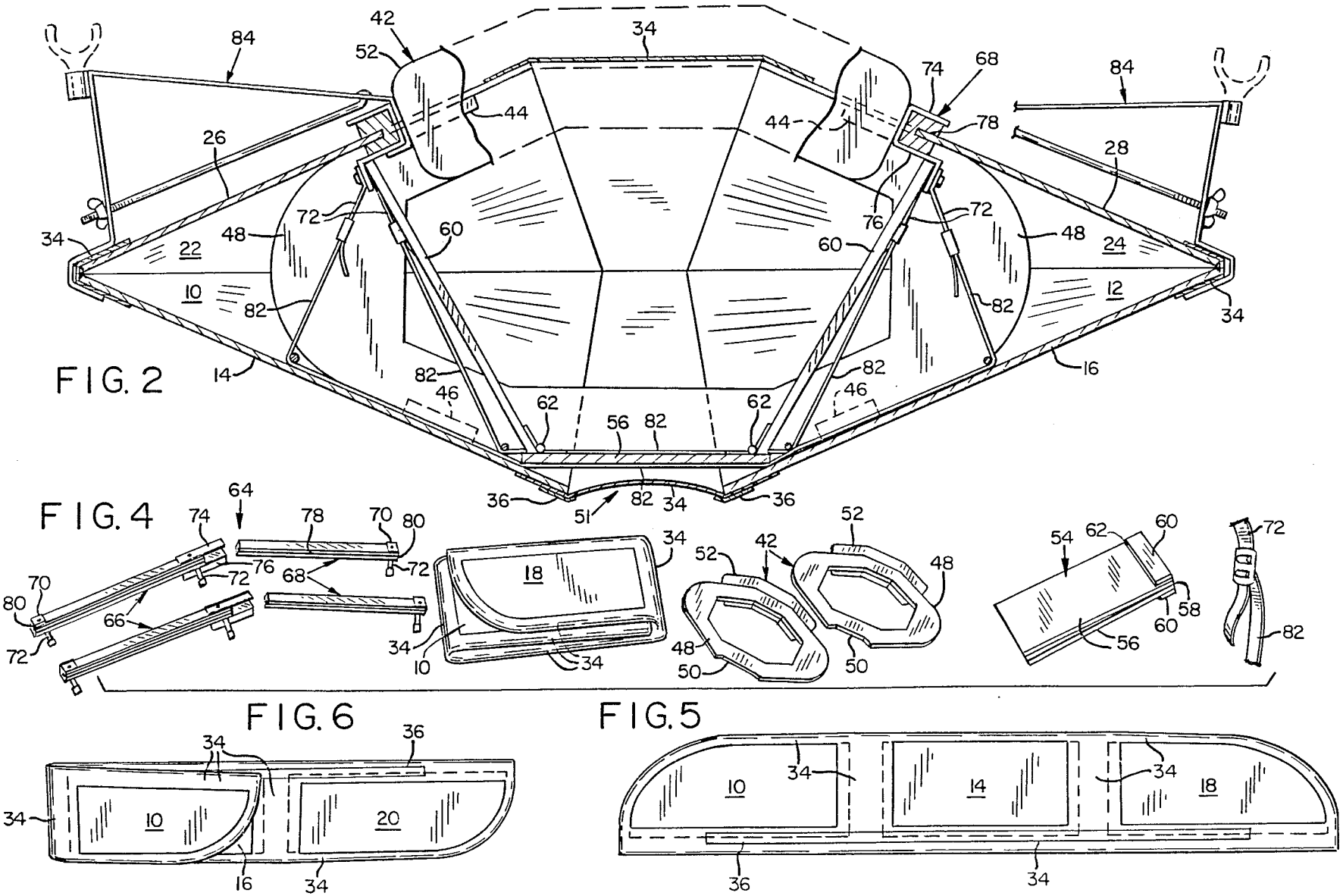
FIG. 2 is an enlarged sectional view taken along line 2—2 of FIG. 1.
FIG. 4 is an exploded view illustrating the separated parts comprising the boat assembly.
FIG. 5 is a detailed view in side elevation of the boat in its longitudinally folded condition.
FIG. 6 is a detailed view in side elevation of the boat in a more advanced stage of folding.

Broadly stated, the collapsible foldable boat of my invention comprises a hull component and associated bracing components, seven in number, which integrate the structure into a rigid, stable, unit which may be used effectively but which, after each use, may be disassembled rapidly and easily to a transportation and storage condition.

As noted above, the hull basically comprises a plurality of waterproof structural plates or panels arranged in spaced relation to each other and interconnected by a plurality of waterproof, flexible connecting pieces sealed to the plates and hinging them to each other.

The plates may be fabricated from any suitable structural material such as plywood, sheet aluminum, reinforced foamed plastic, etc. For economy, ease of manufacture, and performance birch-faced, solid-core mahogany plywood is a panel material of preference.

Twelve such structural plates are employed in the fabrication of the boat in the illustrated form of the invention.

In the discussion which follows, the plates are identified as indicated below, with reference to the plate locations as the boat is viewed in FIG. 1:

10—forward, left bottom plate
12—forward, right bottom plate
14—central, left bottom plate
16—central, right bottom plate
18—rear, left bottom plate
20—rear, right bottom plate
22—forward, left top plate
24—forward, right top plate
26—central, left top plate
28—central, right top plate
30—rear, left top plate
32—rear, right top plate It will be observed that the plates are arranged in spaced longitudinal rows and spaced transverse rows. In the illustrated embodiment of the invention there are two longitudinal plate rows and three transverse plate rows.

Thus plates 10, 14 and 18 are arranged in a first longitudinal bottom row; plates 12, 16 and 20 in a second longitudinal bottom row.

Plates 10 and 12, 14 and 16, and 18 and 20 are arranged in spaced transverse bottom rows.

Superimposed directly above the rows of plates in the bottom of the boat hull are the rows of plates in the top of the boat hull.

Thus, plates 22, 26 and 30 form one top longitudinal row while plates 24, 28, 32, form a second top longitudinal row.

Top plates 22, 24; 26, 28; and 30, 32; form three top transverse rows.

In all of the rows the plates of the upper group are superimposed substantially directly above the plates of the lower rows.

All of the plates are interconnected by means of waterproof, flexible connecting pieces sealed to the plates and hinging them to each other. These pieces are indicated generically by the number 34.

Connecting pieces 34 may be variously shaped and sized to suit their location and purpose. They may be fabricated from any flexible, durable, strong, waterproof material. Nylon-reinforced Neoprene is preferred. The strips are glued to the plates with a substantial marginal overlap, using any suitable adhesive material.

A pair of laterally-spaced, longitudinally-extending wear strips or rub strips 36 protect the bottom of the craft, FIGS. 2 and 5.

The hull thus constituted accordingly comprises a bottom with sloping sides, a forward deck, a pair of side decks, and a rear deck. It also is provided with a forward access opening 38, affording access to the space under the forward deck and a rearward access opening 40 affording access to the space under the rearward deck.

Removable bulkhead means indicated generally at 42 are provided for spacing the top of the boat hull from its bottom, while at the same time partitioning off the areas beneath the forward and rear decks.

To position the bulkheads there are provided bulkhead top chocks or stops 44 and bulkhead bottom chocks or stops 46.

Each bulkhead member 42 comprises a generally elliptical body 48 which has its center cut-away for purposes of access and weight reduction. The bulkhead body is cut away to provide a recess 50 which, together with the floor of the boat, provides a passage for any water flowing between the compartments. It also provides bearing points between the bulkhead and the adjacent structural hull plates. The bearing points, in turn, define a structure which, in cooperation with intervening connecting piece 34, forms an inverted, stabilizing keel indicated generally at 51.

A splash guard 52 is adherently or otherwise affixed to the upper face of the bulkhead body. As illustrated in the drawings, FIG. 7, the plane of the splash guard is offset from the plane of the bulkhead body. This provides a shoulder which assists in mounting the bulkhead in the hull.

Mounting is achieved simply, FIG. 7, by placing the bottom of the bulkhead adjacent bottom chocks 46, lifting the forward or rearward deck, as the case may be, and pressing the bulkhead into the associated access opening. When this has been accomplished, the inner surface of the deck will bear against the shoulder provided by offset splash guard 52, mounting the bulkhead in a wedging, stretching, removable fit.

Assisting bulkheads 42 in stretching and tensioning the hull, is a centrally located keelboard indicated generally at 54.

Like the structural plates of the hull, the keelboard may be fabricated from plywood or other suitable structural material. It is fabricated in two segments each of which is indicated by the numeral 56. The two segments are interconnected end to end by a hinge 58.

For purposes which will appear hereinafter, a pair of struts 60 are hinged to the keelboard segments, adjacent the meeting ends thereof, by means of hinges 62, FIG. 2.

Stops or chocks are provided for installing the keelboard as the bottom member of the boat cockpit in a wedging, stretching fit. Separate chocks may be employed for this purpose. However, it is preferred to use the bases of bulkheads for use as chocks, in the manner shown particularly in FIG. 9.

Keelboard 54 is dimensioned so that it is installed in a press fit between the two bulkheads, further wedging and stretching the hull components into an assembled condition.

This condition is still further realized by the inclusion in the assembly of a pair of side rails indicated generally at 64. These define the gunwales of the craft, FIGS. 1 and 4.

Each side rail 64 preferably comprises a pair of segments 66, 68. Both segments may be made of any suitable structural material, as of wood or metal.

Segment 66 is provided with a terminal fitting 70 which protects the end of the segment. It mounts a strap component 72, FIG. 4.

Segment 66 also mounts a second terminal fitting which serves three functions:

First, it mounts a second strap component 72.

Second, it is formed with a flange 76 which serves as a bearing plate for an associated strut 60.

Third, it is provided with an extension which receives the meeting end of side rail component 68 thereby in effect hinging the two segments together.

The outer end of side rail component 68 also is provided with a fitting 70 which mounts a strap segment 72.

Releasable means are provided for mounting the side rails on the longitudinal side edges of the cockpit, i.e. on the gunwale sections thereof. Tongue and groove means are provided for this purpose.

The groove component of each tongue and groove joint is provided by a longitudinal groove 78 extending along the outer side face of side rail segment 66. It meets with, and communicates with, a corresponding groove 78 in side rail 68, thereby forming a continuous groove along the length of the two members in their assembled condition.

Also provided in each of the side rails is an end groove 80.

The tongue member of the tongue and groove joint is provided by the structural plates or panels comprising the boat hull.

Thus side groove 78 receives the inner edges of side panels 26, 28 in tongue and groove relationship, FIG. 2. End grooves 80 of the side rail segments receive the inner margins of forward and rearward top panels 22, 24 30, 32, respectively.

The manner in which this is accomplished is illustrated in FIG. 10. By inserting the margins of the panels of the hull in the grooves of the side rail segments, a thrusting force is exerted on the hull components which further stretches and wedges them into their assembled condition.

Further to secure the side rails and keelboard, and prevent their inadvertent displacement during use of the boat, a plurality of straps 82 are positioned at spaced intervals longitudinally of the cockpit. These engage releasably strap components 72, noted hereinabove.

Operation

The manner of operation of the herein described collapsible foldable boat is as follows:

To collapse and fold the boat, with all the framing components removed, the boat is placed flat on the ground. It then is folded longitudinally in the middle to assume the partly folded condition of FIG. 5. It will be noted that the aligned component plates of the whole structure substantially overlie each other in this position of the partly folded hull.

Next the longitudinally folded hull is folded transversely in two stages. In the first stage of FIG. 6, one end section is folded over. In the second stage of FIG. 4, the other end section is folded over to produce the compact bundle of the latter figure. Together with the separated framing components, the folded hull may be packaged suitably for storage and transportation.

When it is desired to use the boat, the hull is unfolded by reversing the above described sequence of steps. It then is stretched and framed in the manner illustrated particularly in FIGS. 7–10 inclusive.

First the bulkhead members 42 are inserted in the boat in the manner illustrated in FIG. 8.

Next, the edges of the decks of the boat are lifted and the respective bulkhead members applied in the manner illustrated in FIG. 7, making sure that the bottoms of the bulkhead members bear against lower chocks 46, and the shouldered upper portions of the bulkhead members bear against upper chocks 44.

Next the keelboard 54 is inserted between the two bulkheads and pushed down in the manner illustrated in FIG. 9. This further stretches and tensions the boat.

Next side rails 64 are inserted in the manner illustrated in FIG. 10, further to stretch and tension the hull.

Straps 82 are connected to the associated strap segments 72. It will be noted that for best results, the end straps are positioned on top of keelboard 54, while the center strap is positioned beneath the same.

Finally struts 60 are flipped up into bearing engagement with bearing flanges 76 on the side rails. The result is the assembled boat of FIG. 1, ready for use.

To collapse the boat, the foregoing sequence of steps is reversed, the framing components removed, and the boat hull folded in the manner above described.

Having thus described in detail a preferred embodiment of the present invention, it will be apparent to those skilled in the art that various physical changes could be made in the device described herein without altering the inventive concepts and principles embodied. The present embodiment is to be considered in all respects as illustrative and not restrictive, the scope of the invention being indicated by the appended claims rather than by the foregoing description. All changes which come within the meaning and range of equivalency of the claims are therefore to be embraced therein.

I claim:

1. A collapsible, foldable boat comprising:

(a) a plurality of waterproof structural plates arranged in spaced relation to each other in the form of a boat hull defined by a bottom with sloping sides, a forward deck, a rear deck, and a central cockpit, the plates being arranged in two spaced longitudinal rows and three spaced transverse rows, and (b) a plurality of waterproof, flexible connecting pieces sealed to the plates and hinging them to each other.

2. A collapsible, foldable boat comprising:

(a) a plurality of waterproof, structural plates arranged in spaced relation to each other in the form of a boat hull defined by a bottom with sloping sides, a forward deck with associated forward access opening, a rearward deck with associated rearward access opening, two side decks between the front and rear decks, and a central cockpit, (b) the plates being arranged in spaced longitudinal rows and spaced transverse rows to enable folding the hull, (c) a plurality of waterproof, flexible connecting pieces sealed to the plates and hinging them to each other, and (d) removable bulkhead means dimensioned for insertion in the access openings.

3. The boat of claim 2 wherein the bulkhead means is dimensioned for a friction fit within the access openings.

4. The boat of claim 2 including splashboard means affixed to the upper margin of the bulkhead means and extending upwardly above the upper surface of the hull.

5. The boat of claim 2 including stop means fore and aft on the floor, and hinged keelboard means arranged to lie on the floor between the stop means in a wedging, stretching fit.

6. The boat of claim 5 wherein the stop means comprise the bulkhead means.

7. The boat of claim 2 including side rails mounted on the upper margin of the hull, one on each side of the cockpit between the decks.

8. The boat of claim 7 wherein the side rails comprise segmental side rails mounted between the decks in a wedging, stretching fit.

9. The boat of claim 8 including tongue and groove releasable securing means securing the side rails releasably to the decks.

10. The boat of claim 9 wherein the side rails are provided with longitudinal grooves and the plates comprise the tongues of the tongue and groove securing means.

11. The boat of claim 2 including stop means fore and aft on the floor, a hinged keel board arranged to lie on the floor between the stop means in a wedging stretching fit, and segmental side rails arranged one on each side of the cockpit between the decks in a wedging, stretching fit.

12. The boat of claim 11 including strut means insertable between the keelboard and the side rails.

13. The boat of claim 12 including hinge means hinging one end of the strut means to the keelboard, the free end of the strut means being dimensioned for a forced, releasable fit against the side rails.

14. The boat of claim 11 including strap means releasably tying together at spaced longitudinal intervals, the keelboard and side rails in the assembled condition of the boat.

* * * * *